US007527567B2

(12) United States Patent
Ohle

(10) Patent No.: US 7,527,567 B2
(45) Date of Patent: May 5, 2009

(54) DEVICE FOR ATTACHING A SOCCER BALL TO A SOCCER KICKING TRAINING APPARATUS

(76) Inventor: Robert D. Ohle, 537 S. Flower St., Lakewood, CO (US) 80226

( * ) Notice: Subject to any disclaimer, the term of this patent is extended or adjusted under 35 U.S.C. 154(b) by 80 days.

(21) Appl. No.: 11/746,885

(22) Filed: May 10, 2007

(65) Prior Publication Data

US 2008/0280702 A1 Nov. 13, 2008

(51) Int. Cl.
*A63B 69/00* (2006.01)

(52) U.S. Cl. ..... 473/422; 473/423; 473/446; 473/420

(58) Field of Classification Search ..... 473/422, 473/423, 427, 429, 438, 439, 446, 476–479
See application file for complete search history.

(56) References Cited

U.S. PATENT DOCUMENTS 2,328,744 A 9/1943 Roters
2,936,139 A * 5/1960 Lindstrom ..... 248/362
4,133,575 A * 1/1979 Mader ..... 248/205.8
4,307,888 A 12/1981 Ohle
4,477,083 A 10/1984 Sowards
4,516,769 A 5/1985 Kopp
4,561,661 A 12/1985 Walker et al.
4,576,379 A 3/1986 Juhasz
4,616,834 A 10/1986 Davis
4,720,095 A 1/1988 Sowards
5,037,113 A 8/1991 Sowards
5,381,990 A * 1/1995 Belokin et al. ..... 248/362
5,435,572 A 7/1995 Covel
5,494,278 A 2/1996 Linden
5,618,039 A 4/1997 Tsai et al.
5,711,501 A * 1/1998 Belokin et al. ..... 248/205.9
5,755,631 A * 5/1998 Paschka ..... 473/459
5,797,815 A * 8/1998 Goldman et al. ..... 473/588
5,951,414 A 9/1999 Sowards
6,053,464 A * 4/2000 Cardarelli ..... 248/205.8
6,475,108 B1 11/2002 Sarenana, Sr. et al.
7,056,236 B2 6/2006 Ohle
7,137,909 B2 11/2006 Ohle

* cited by examiner

*Primary Examiner*—Mitra Aryanpour
(74) *Attorney, Agent, or Firm*—Dorr, Carson & Birney, P.C.

(57) ABSTRACT

A soccer kicking practice apparatus is provided with a domed bolt shaft receiver for mounting a soccer ball having a protruding threaded bolt to a soccer ball holder. In the alternative the soccer kicking practice may employ a soccer ball having a nut to receive a threaded bolt mounted to a knob.

9 Claims, 8 Drawing Sheets

Fig. 6A
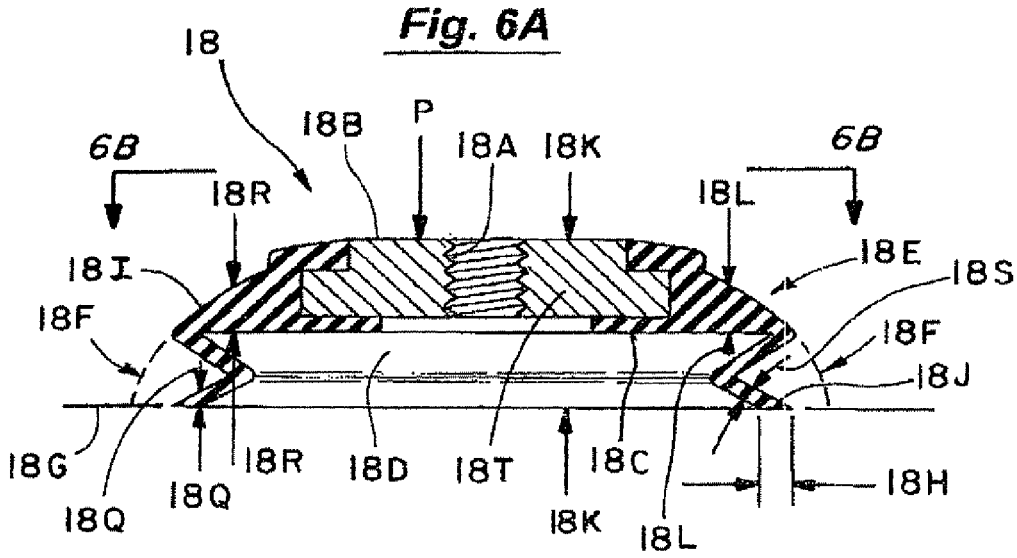
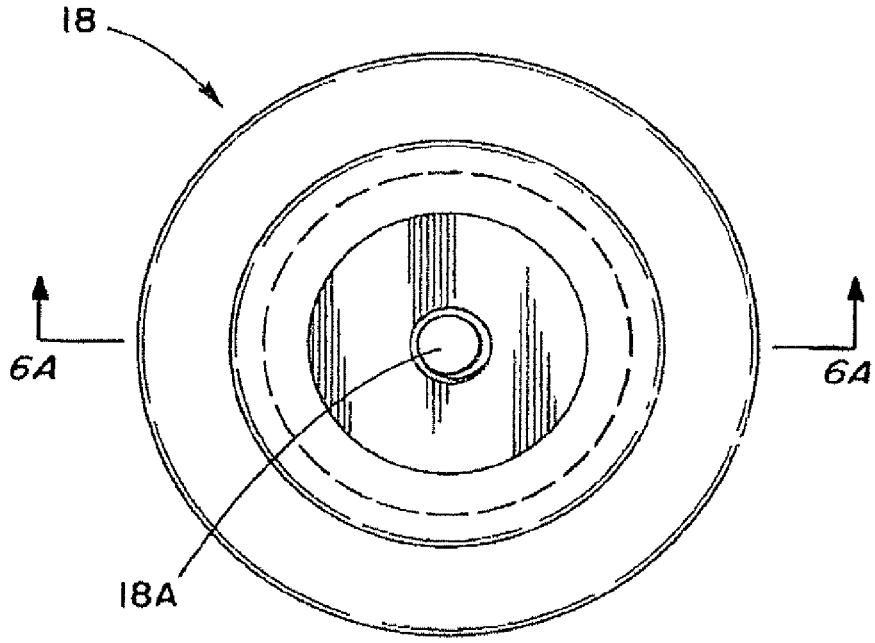
Fig. 6B

DEVICE FOR ATTACHING A SOCCER BALL TO A SOCCER KICKING TRAINING APPARATUS

BACKGROUND OF THE INVENTION

1. Field of the Invention

The present invention generally relates to certain soccer ball kicking practice devices. More specifically, this invention is concerned with attaching a soccer ball to such soccer ball kicking practice devices.

2. Discussion of the Background

U.S. Pat. Nos. 7,056,236 and 7,137,909 to Ohle ("the Ohle patents") teach soccer ball kicking practice apparatus having a roller chain center device/coil spring biasing system that serves to return a soccer ball to its original position after it has been kicked. These patents teach that an outside end of an elongated soccer ball mounting arm can be provided with a soccer ball mounting device wherein a bolt (that is incorporated into a soccer ball) is attached to the mounting arm.

FIG. 13 of the Ohle patents show a side cut-away view of a soccer ball 227 provided with a mounting bolt that is attached to a soccer ball abutment/mounting piece 236. The soccer ball 227 has an outer cover 228 and an inner air-inflatable bladder 230 common to most commercially available soccer balls. A threaded portion of the mounting bolt 232 passes through a hole 234 in the soccer ball cover 228. This bolt 232 is also shown passing through the soccer ball abutment/mounting piece 236. Such an abutment/mounting piece 236 may have a flat outer surface or a concave outer surface 238 to receive and better seat the round outer surface of a soccer ball. The soccer ball cover 228 and soccer ball abutment/mounting piece 236 can be tightly abutted to each other through use of a threaded nut 240 that is threadedly engaged with the bolt 232. A washer 242 also can be placed between the inside 244 of the soccer ball cover 228 and the bolt head 246. In the alternative, the bolt head 246 could be on the outside of the abutment mounting piece 236. A bolt head padding piece 248 is placed between the bolt head 246 and the bladder 230. Ohle's FIG. 13 shows the soccer ball 227 abutted against the right side 250 of the soccer ball abutment/mounting piece 236. In the alternative such a ball 227 can be mounted on the left side 252 of said abutment/mounting piece 236. The left side 252 of the abutment/mounting piece 236 is shown optionally provided with a padding material 254 having a concave outer surface 238 for seating the round outer surface of a soccer ball.

Some drawbacks have however become manifest in the soccer ball mounting system disclosed in the Ohle patents. One of these follows from the fact that, upon being kicked, the soccer ball 227 tends to wobble on the ball abutment/mounting piece in the region immediately surrounding the hole 234 in the ball cover 228 through which the bolt 232 protrudes from the interior of the ball. Elimination of this wobble tends to produce a more uniform spatial positioning of the ball upon its return. Moreover, the resulting wear on the ball cover as a result of this wobbling in the region immediately surrounding the hole 234 may lead to a need for a relatively early replacement of the ball. The device of the present patent disclosure deals with the above noted drawbacks and significantly extends the useful life of the soccer ball.

SUMMARY OF THE INVENTION

The present invention discloses a soccer ball mounting device that can be employed with a soccer ball having a protruding bolt such as those disclosed in the Ohle patents. These Ohle patents are incorporated herein by reference. The ball return attribute of the present invention could be accomplished by a kicking practice apparatus that is provided with an elongated soccer ball mounting arm that has a roller chain center device that is substantially surrounded by an elongated coil spring in the manner taught by Ohle. It might also be noted in passing here that a roller chain center device such as that taught by Ohle is flexible in a substantially horizontal plane, but is not flexible in a substantially vertical plane. Thus, a soccer ball mounted to a soccer kicking practice apparatus employing such a roller chain center shaft can be easily kicked in a generally horizontal plane, but can not be easily kicked in a generally vertical plane since a roller chain mounted in that manner will not readily bend in a vertical direction. For safety reasons, the coil spring of such an apparatus can be covered by a padding material such as a polymeric material having a sheath-like configuration that substantially covers such a spring.

In certain embodiments of the present invention a comparable coil spring can be further provided with a spring compression/decompression device similar to that taught in the Ohle patents. That is to say that a coil spring of the present patent disclosure can likewise be placed in a given state of compression supplied by fixed abutment surfaces, or it can be placed between abutting surfaces wherein at least one of said abutting surfaces can be moved and thereby compress/decompress the coil spring. In either case, however, applicant has found that a flexible center shaft and surrounding coil spring construction arrangement can serve to bring a kicked ball, mounted according to the teachings of the present invention, back to a predetermined position in a desirably short period of time.

It should, however, also be appreciated that applicant's present device for attaching a soccer ball to a soccer kicking training apparatus can be used on any kicking training apparatus that uses a soccer ball that is attached to a mounting bolt system. For example, the Ohle patents also teach the use of mounting arms made of elastomeric materials (see FIG. 2 of the Ohle patents) or coil springs (see FIGS. 6, 7 and 9 of the Ohle patents). These mounting arms are flexible in the vertical direction as well as the horizontal. This all goes to say that, be their mounting arms as they may, all of applicant's present devices for attaching a soccer ball to a soccer kicking training apparatus can be adapted and arranged to cooperate with a specially constructed soccer ball that contains either: (1) a protruding threaded bolt or (2) a nut for receiving a threaded bolt that protrudes from a knob. In this second embodiment, applicant's kicking training apparatus is provided with a knob (or handle) that is affixed to a threaded bolt that threads into a threaded nut that is physically associated with a soccer ball. Such a threaded nut could, for example, be placed under the ball's cover behind an opening therein that permits passage of a front region of a threaded bolt shaft that projects from such a knob or handle.

An elongated soccer ball mounting arm of the present patent disclosure also may have a soccer ball mounting end and a connector end a la the teachings of the Ohle patents. The soccer ball mounting end will, however, be provided with a soccer ball mounting device of the type disclosed in the present patent disclosure. For example, this soccer ball mounting device may be in the form of a mounting plate having a hole for receiving a threaded bolt that is attached to a soccer ball in one of applicant's two alternate ways. In either case, the soccer ball mounting device of the present patent disclosure will differ from those taught by the Ohle patents in that the present mounting device also has a domed bolt shaft receiver positioned between its mounting plate and the cover of the soccer ball. This domed bolt shaft receiver will be more fully described in subsequent parts of this patent disclosure.

In some embodiments of the present invention, the opposite end of a mounting arm of this patent disclosure will be provided with a connector device comparable to those taught by the Ohle patents. Generally speaking, such connector devices will serve to connect an elongated soccer ball mounting arm to a holding post or to a construction element. Various different kinds of connector devices such as those taught in the Ohle patents can be employed in the present invention as well. These connector devices may directly attach to a mounting surface such as a wall, a post, a tree, etc. Subsequent parts of this patent disclosure will also disclose certain other optional features in the hereindescribed invention. For example, the hereindescribed apparatus may be provided with various protective layer(s) of padding material in select portions of the overall apparatus e.g., around the extended coil spring of the soccer ball mounting device.

BRIEF DESCRIPTION OF THE DRAWINGS

FIG. 6A is a cut-away side view of the domed bolt shaft receiver of the present patent disclosure.

FIG. 6B is a plan view of the domed bolt shaft receiver of FIG. 6A.

DETAILED DESCRIPTION OF THE INVENTION

Figure 1:
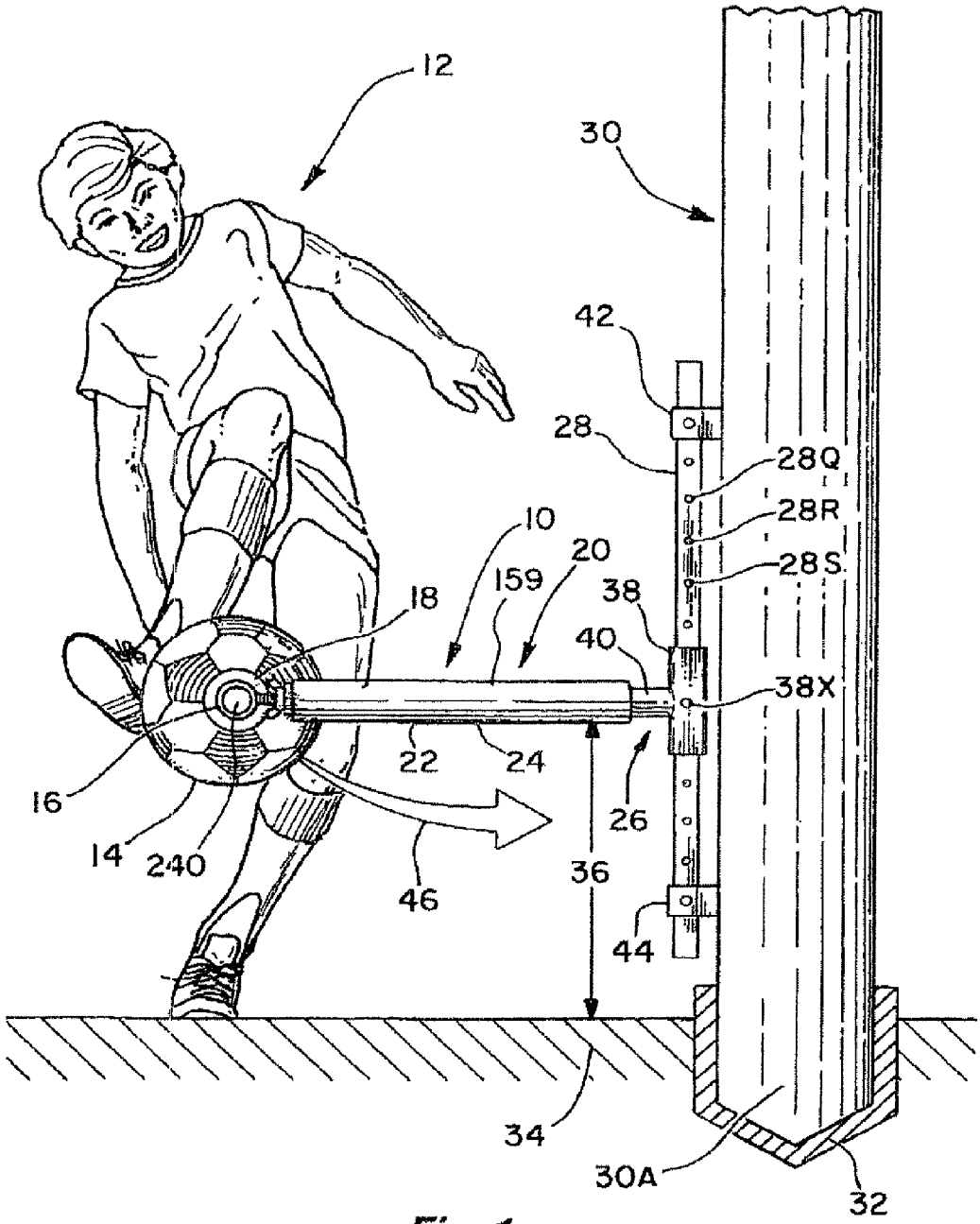
FIG. 1 is a frontal view of an embodiment of the soccer kicking practice apparatus of this patent disclosure being used by a human being in its generally intended manner.

FIG. 1 depicts a soccer kicking practice apparatus 10 of this patent disclosure being used by a human being 12. A soccer ball 14 is shown attached to a soccer ball holder 16. A domed bolt shaft receiver 18 and bolt shaft receiver knob 240 cover a bolt (not shown) that is attached to the soccer ball 14 in a manner hereinafter more fully described with respect to FIGS. 6-8. The soccer ball holder 16 is attached to an outer end of an elongated soccer ball mounting arm having a roller chain center device 22 (not shown) and a coil spring 24 (not shown) that substantially surrounds the roller chain center device 22. The coil spring 24 is in turn surrounded by a padding material 159. An inner end of the elongated soccer ball mounting arm 20 is shown attached to a T-shaped connector 26. The T-shaped connector 26 is shown mounted to a holding post 28. The holding post 28, in turn, is mounted (in a substantially vertical orientation) to a structural element 30. This structural element 30 could for example be an inside wall or an outside wall of a building, a post in the ground, a tree trunk or other suitably strong structure that presents a substantially vertical surface to which this (holding post 28 containing) embodiment of the invention can be mounted. By way of example only, the structural element 30 shown in FIG. 1 is depicted as being a wooden post that is set up in a post holder 32 that is sunk into the ground 34.

FIG. 1 also depicts the elongated soccer ball mounting arm 20 positioned at a desired elevation 36. Some embodiments of this invention provide for varying this mounting arm elevation 36. This variability can, for example, be achieved through use of a T-shaped connector 26 whose T-top element 38 is slidably mounted on a vertically mounted holding post 28. The T-stem element 40 of the T-shaped connector 26 is attached to the elongated soccer ball mounting arm 20 (e.g., attached to the roller chain center device of said mounting arm 20). The mechanism by which the T-top element 38 can be moved vertically up and down the holding post 28 is more fully detailed in FIG. 5.

In FIG. 1, the T-top element 38 is shown provided with a hollow shaft (see item 206 in FIG. 5) that encompasses the holding post 28 such that the hollow shaft can slide up or down the holding post 28 between its top and bottom. The holding post 28 of FIG. 1 also is shown provided with an array of holes e.g., holes 28Q, 28R, 28S that extend through the side of the holding post 28 and through its opposite side. The T-top element 38 is provided with a hole 38X that extends through top element 38 to its opposite side. Thus, a desired elevation 36 of the soccer ball mounting arm 20 can be fixed by aligning the hole 38X in the T-top element 38 with a given hole (e.g., hole 28S) in the vertical post 28 and inserting a bolt, dowel rod, cotter key or other such holding device into the aligned holes and thereby holding the mounting arm 20 (and hence the soccer ball 14 attached to it) at some desired elevation 36. For example, the elevation 36 can be set such that a human being 12 can practice kicking the soccer ball in a generally horizontal plane such as that suggested by direction arrow 46 in FIG. 1.

Figure 2:
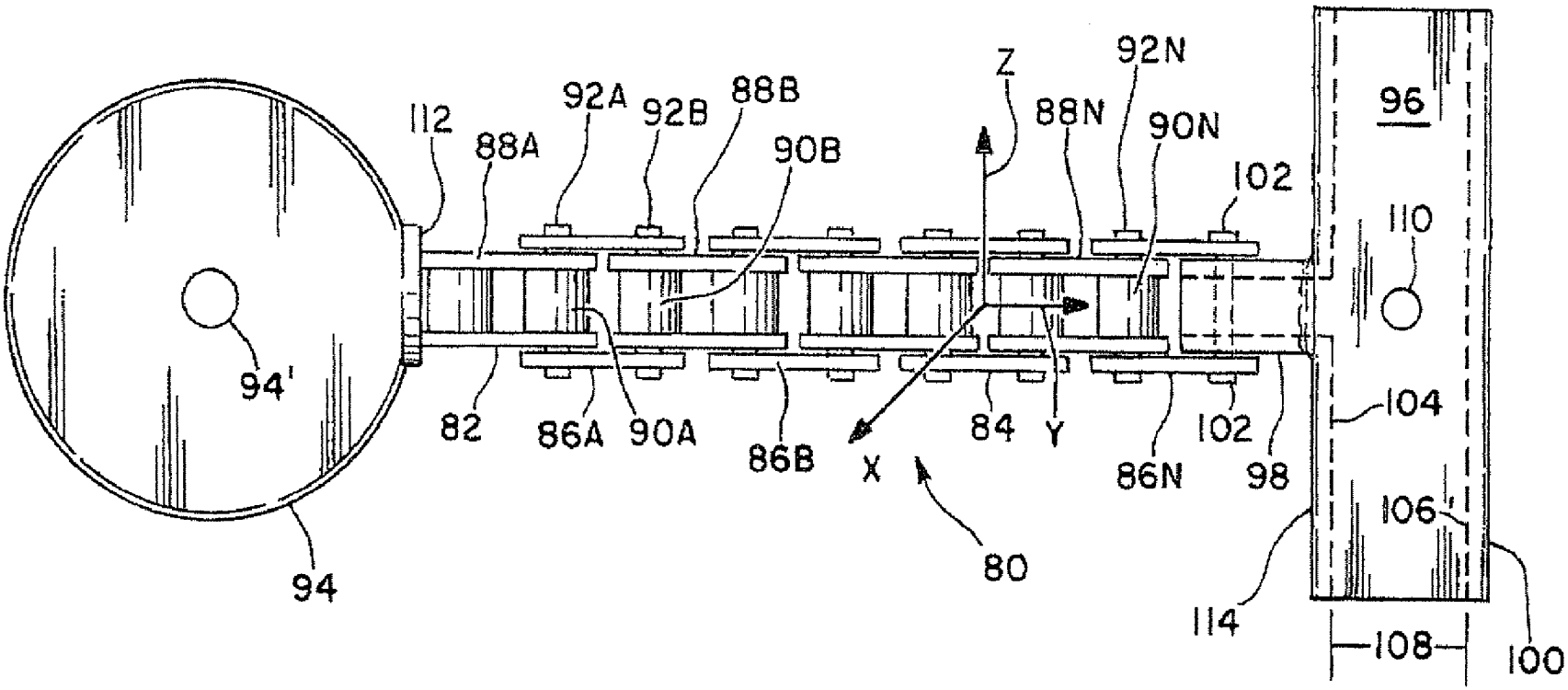
Fig. 2 (Prior Art)
FIG. 2 depicts a prior art elongated soccer ball mounting arm whose center shaft is a roller chain.

FIG. 2 depicts an elongated soccer ball mounting arm 80 whose center shaft 82 is in the form of a roller chain 84 as disclosed in the Ohle patents. Such roller chains are well known devices. For example, they are commonly used on motorcycles, bicycles, and power driven chain systems for various industrial machines. They are typically used in conjunction with powered sprocket devices whose teeth engage the roller chain. Such roller chains typically have a series of outer link members 86A, 86B . . . 86N; a series of inner link members 88A, 88B . . . 88N; and a series or rollers 90A, 90B . . . 90N held together in a flexible array by a series of bolts or pins 92A, 92B . . . 92N. The outside (left side) of the roller chain 84 is shown attached to a soccer ball holder 94 (denoted as item 16 in FIG. 1) having a hole 94' for receiving a bolt that is, in turn, attached to a soccer ball in the manner hereinafter depicted in FIG. 8. The inside (right) end of the elongated soccer ball mounting arm 80 (denoted as item 20 in FIG. 1) is shown attached to the top of a T-shaped connector 96 (denoted as item 38 in FIG. 1). This T-shaped connector 96 has a sideward orientation such that the T's stem portion 98 is generally horizontally oriented while the T's top element 100 is generally vertically oriented. The inside end (right end) of the roller chain 80 is shown attached to the end of the horizontally oriented stem portion 98 (denoted as item 40 in FIG. 1) of the T-shaped connector 96 through use of a mounting pin 102 that passes through both the outer link member 86N and the body of the stem portion 98 of the T-shaped connecter 96.

The inside walls 104 and 106 of the top 100 of the T-shaped connector 96 is shown in phantom lines to illustrate that the top 100 of said connector 96 contains a hole 108. Such a hole 108 can receive the body of a vertically oriented holding post (such as that depicted as item 28 in FIG. 1) and thereby providing a method by which the elongated soccer ball mounting arm 80 can be slidably mounted on such a holding post. The T-shaped connector 96 can be held at some desired elevation (such as that depicted by item 36 in FIG. 1) by passing a holding device (e.g., such as a bolt, pin, cotter key, etc.) through a hole 110 in the top 100 of the T-shaped connector 96 and an analogous hole in the body of the holding post (see for example items 28Q, 28R, 28S in the vertical post 28 shown in FIG. 1).

The outside (left side) of the roller chain 84 is shown providing with a left spring end abutment surface 112. The stem portion 98 of this connector 96 can be provided with a right spring end abutment surface (not shown). In the alternative, the right spring end abutment surface may be provided by the body of the top 100 of the T-shaped connector 96 in a region generally indicated by item number 114. A final point that might be noted with respect to the roller chain 84 shown in FIG. 2 is that it is shown provided with an XYZ Cartesian coordinate system superimposed on its body. It is there to illustrate that the roller chain 84 is highly flexible in the X axis direction, but is not very flexible in either the Y axis or the Z axis. This X axis flexibility is, for example, suggested by item 46 in FIG. 1.

Figure 3:
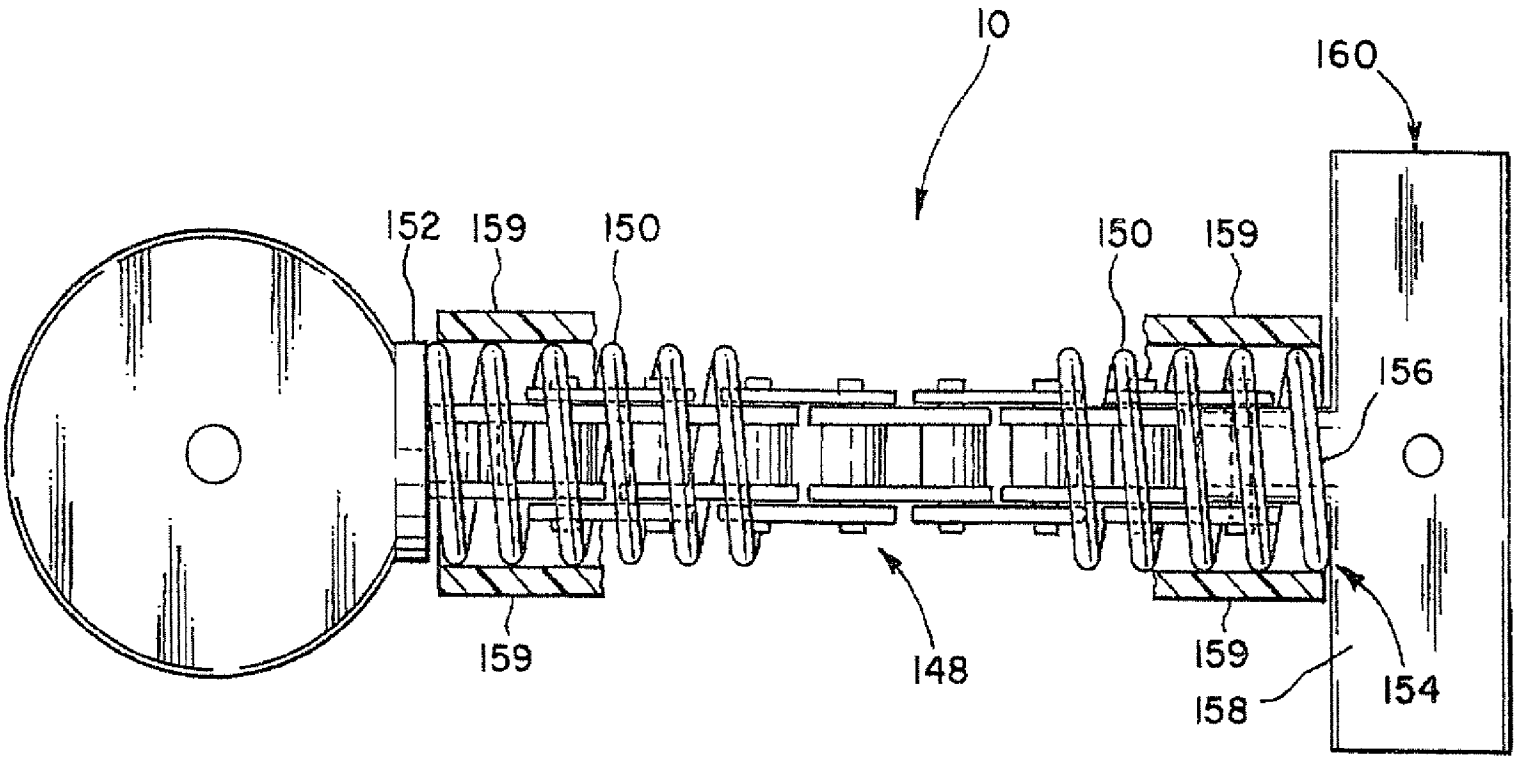
Fig. 3 (Prior Art)
FIG. 3 depicts the prior art chain roller of the elongated soccer ball mounting arm depicted in FIG. 2 partially surrounded by a coil spring whose center region has been removed in order to better illustrate the presence of the chain roller.

FIG. 3 depicts an embodiment of this invention wherein a roller chain type center shaft 148 is shown surrounded with a coil spring 150 whose center region is shown removed for purposes of better illustrating the details of the roller chain type center shaft 148. The coil spring 150 is shown residing between a left spring end abutting surface 152 and a right spring end abutting surface 154 which is in fact a right portion 156 of the vertical component 158 of a T-shaped connector 160. FIG. 3 also depicts cut-away portions of padding 159 (e.g., having a sheath-like configuration) surrounding the spring 150 in a generally sheath-like configuration.

Figure 4:
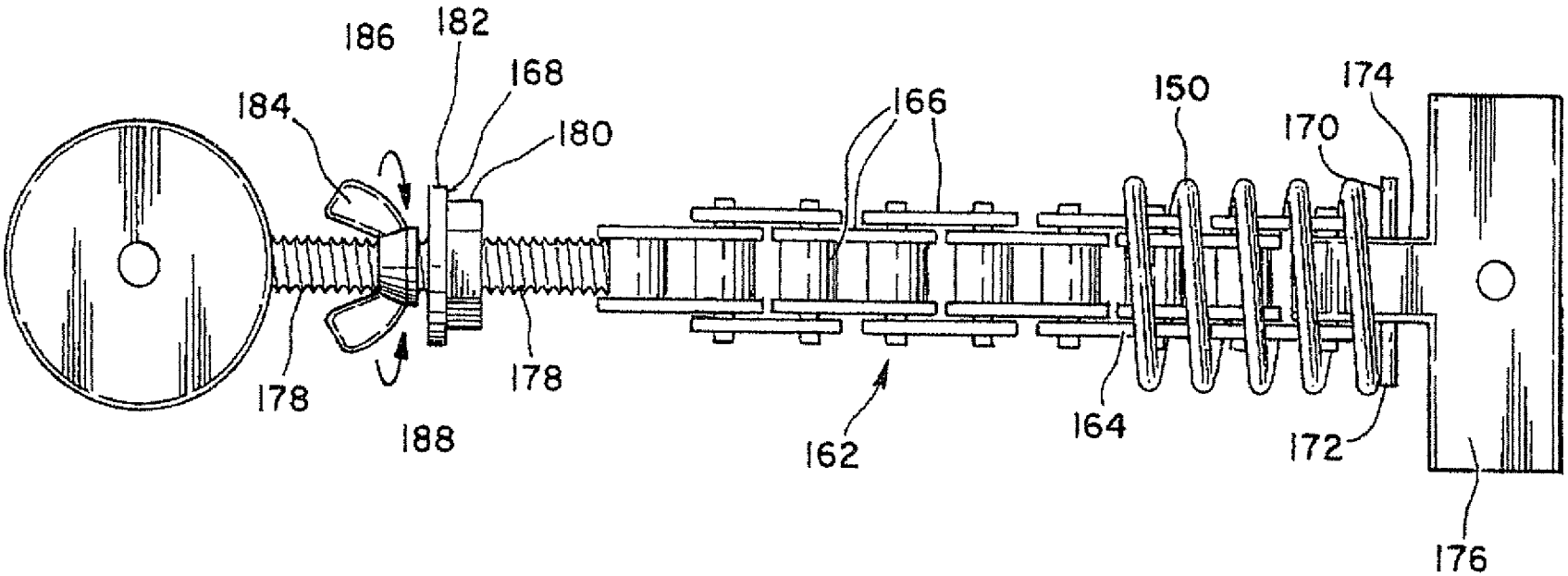
Fig. 4 (Prior Art)
FIG. 4 depicts a prior art chain roller center shaft that is further provided with a prior art spring compression/decompression device.

FIG. 4 also illustrates an elongated soccer ball mounting arm 162 whose center shaft 164 is a roller chain system 166. Such a roller chain system 166 will be surrounded by a coil spring (partially shown). The coil spring 150 will generally reside between a left side spring abutting surface 168 and a right side spring abutting surface 170 e.g., such as that provided by a bolt, pin, rod, etc. 172 that protrudes from a stem portion 174 of a T-shaped connector 176. This elongated soccer ball mounting arm 162 differs from the others heretofore described in that said arm 162 further comprises a threaded shaft 178 to which a threaded bolt 180 is threadedly mounted. The threaded bolt 180 can be (but need not be) attached to a washer 182 that provides the left side spring abutting surface 168 previously discussed.

An alternative mounting arrangement could be provided by placing the washer 182 on the right side of the bolt 180 rather than on the left end of said bolt 180. In either case, the washer 182 may be either free sliding or welded to the bolt 180. Be that bolt/washer arrangement as it may, a wingnut 184 is shown threadedly mounted to the threaded shaft 178. Thus, as the wingnut 184 is threaded toward the elongated soccer ball mounting arm 162, a coil spring (only partially shown) residing between the left side spring abutting surface 168 and the right side spring abutting surface 170 will be placed in a greater state of compression as the pressure created by turning the wingnut 184 (e.g., a clockwise turning as suggested by direction arrow 186) and thereby compressing the coil spring 150. Decompression of the coil spring 150 can be accomplished by turning the wingnut 184 in an opposite direction (e.g., the counterclockwise direction suggested by direction arrow 188) such that the wingnut moves away from the elongated soccer ball mounting arm 162. Again, this compression/decompression of the spring influences the speed at which the kicked ball is returned to its original position as well as the force needed to kick the ball in a given manner.

Figures 5A, 5B:
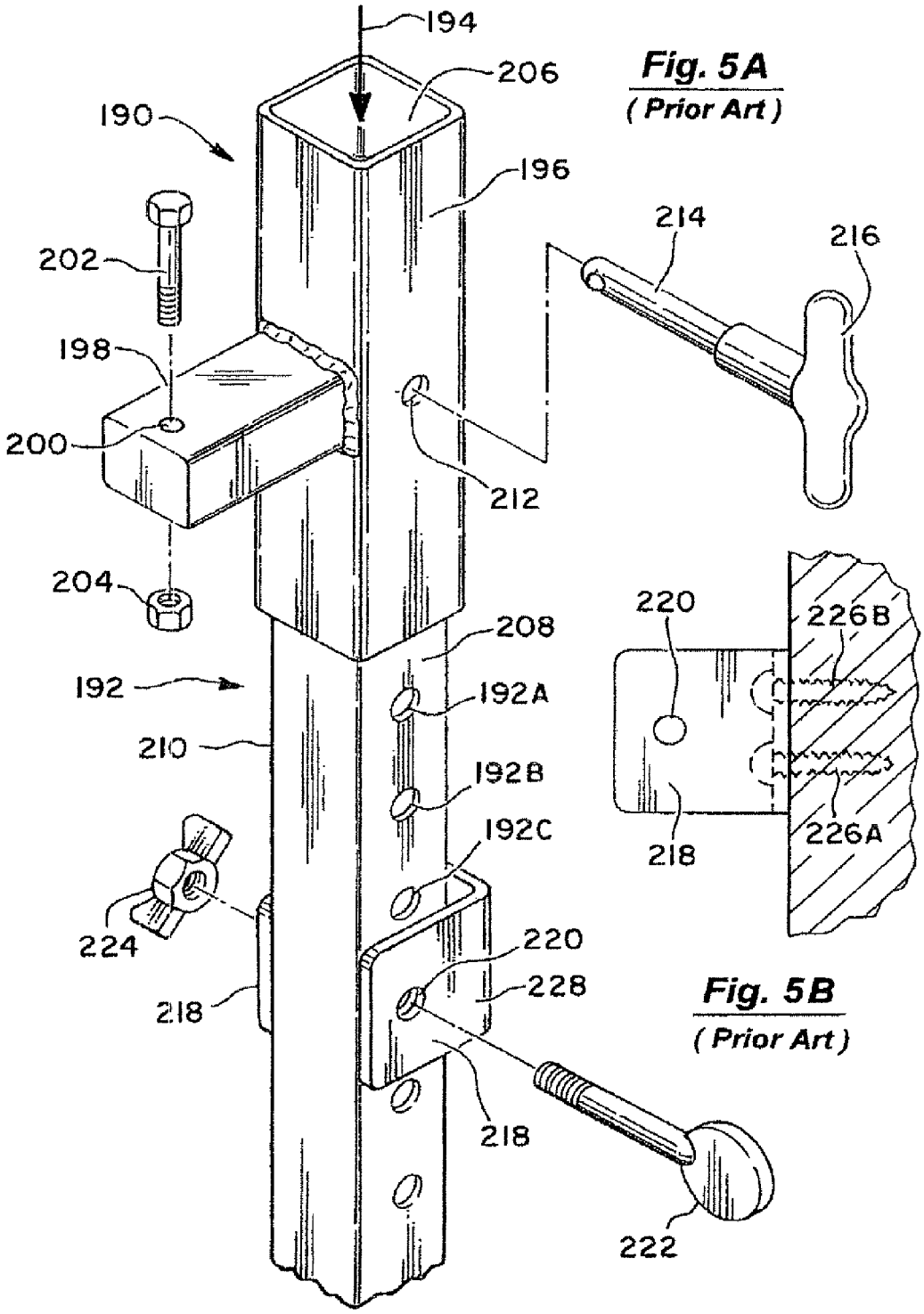
Fig. 5A (Prior Art)
Fig. 5B (Prior Art)
FIG. 5A is a perspective view of a prior art T-shaped connector being slidably mounted to a holding post.
FIG. 5B is a detail of FIG. 5A.

FIG. 5A is a perspective view of a T-shaped connector 190 that is about to be slidably mounted to a holding post 192 in the manner suggested by the direction of arrow 194. The T-shaped connector 190 has a top element 196 and a stem element 198. The stem element 198 is also shown further provided with a hole 200 for receiving a bolt 202 that can be attached to a nut 204 for mounting a center shaft component (not shown) and/or an abutting surface (not shown) for a coil spring (not shown). The top 196 of the T-shaped connector 190 has a hole 206 capable of slidably receiving the body of the holding post 192. The right side 208 of the holding post 192 is shown provided with a series of holes 192A, 192B, 192C, etc. These holes extend through the body of the holding post 192 to and through its left side component 210.

The top 196 of the T-shaped connector 190 is also shown provided with a hole 212 that extends to and through the opposite side of the top 196. The T-shaped connector 190 can be slid up or down the holding post 192 to a desired located wherein the hole 212 in the top 196 of the T-shaped connector 190 is aligned with a desired hole (e.g., hole 192B) in the vertical post 192. A holding rod 214 is then inserted into the aligned holes (212 and 192B). Thus, the T-shaped connector 190, and hence an elongated soccer ball holding arm (not shown) attached to it, is held at a desired elevation such as the elevation 36 depicted in FIG. 1. For convenience, the holding rod 214 can be provided with a handle 216.

The holding post 192 is also shown provided with a holding post attachment device 218 for attaching the holding post 192 to a construction element (a post, a wall, a tree, etc.) having a vertical surface such as the post 30 depicted in FIG. 1. Two such holding post attachment devices (analogous to items 42 and 44 in FIG. 1) will normally be employed. This attachment device 218 is also shown provided with a hole 220 for receiving a holding post attachment bolt 222 that is capable of passing through the holding post attachment device, and the holding post 192 and being provided with a nut 224. Again, however, the mounting arm of the present invention may take other forms such as those depicted in FIGS. 2, 6, 7, 8 and 9 of the Ohle patents.

FIG. 5B shows a side view of the holding post attachment device 218 of FIG. 5A wherein said attachment device is further provided with two wood screws 226A and 226B for attaching the holding post attachment device 218 to a suitable construction element such as the post 30 depicted in FIG. 1.

FIG. 6A is a side cut-away side view of the domed bolt shaft receiver 18 (or "receiver 18") depicted in use in FIG. 1 of the present patent disclosure. FIG. 6B is its plan view. As seen in FIG. 6A, this receiver 18 has a generally domed or saucer-like cross sectional configuration. The side walls of such a saucer-like cross section may have a serrated configuration whose function will be hereinafter more fully described. A top region of the domed bolt shaft receiver 18 will be provided with a hole 18A capable of passing a threaded bolt. The threaded bolt may be attached to a soccer ball (not shown) or to a knob or handle (not shown). In either case, the hole 18A can be threaded (as shown in FIG. 6A) or unthreaded. The top outside surface 18B of the receiver 18 will be generally flat to facilitate application of a downward pressure P placed upon the top outside surface 18B by a bolt shaft receiver nut that, in a first embodiment of this invention, is embedded in a knob (not shown in FIG. 6, but depicted as item 240 in FIG. 8). The underside 18C of the domed bolt shaft receiver 18 may have a generally flat configuration as well. The inside of the receiver 18 will have a hollow cavity 18D that serves to create the dome-like configuration of said receiver 18. This hollow cavity 18D will facilitate a downward compressibility of the receiver 18 under the pressure P provided by, for example, turning an internally threaded bolt receiver knob such as the one depicted as item 240 in FIG. 8. In effect such a knob 240 can serve as a nut for a threaded bolt that protrudes from the soccer ball. It might be noted once again that an alternative embodiment of this invention could employ a knob 240 that is affixed to a threaded bolt shaft (as it is in FIG. 7) that is threaded into a nut that is affixed to a soccer ball, e.g., a nut that is positioned under the soccer ball cover and immediately behind a hole in the cover for receiving a front end of a threaded bolt. Both embodiments of this invention serve to compress the receiver 18 between a mounting plate (see item 16 of FIGS. 7 and 8) and the soccer ball's outer cover.

The side(s) 18E of the receiver 18 may have several possible cross-sectional configurations. For example, as suggested by the dotted lines 18F in FIG. 6A, the outside surface 18E of the dome 18 could simply extend to the base line 18G and thereby forming a generally smooth outside surface 18E and a lip around the bottom of the receiver 18. This lip will be capable of generally conforming to the round contour of the ball cover under the influence of the pressure P.

Again, FIG. 6A shows the side(s) 18E of the receiver 18 having a serrated or layered or aproned or skirted (all these terms of analogy meaning the same thing) cross sectional configuration. For example the side(s) 18E of the receiver 18 can be thought of as having a top apron layer 18I and a bottom skirt layer 18J. These designs could have up to about four separate ascending apron layers above the skirt layer 18J depending upon the desired amount of vertical compressibility of the receiver 18 under a given pressure P. Here again, the bottom edge or lip 18H of the skirt layer 18J also is capable of generally conforming to the outer contour of the ball under the influence of the pressure P.

The overall compressibility of the receiver 18 is suggested by the compression depicting arrows 18K-18K. A portion of this overall compressibility may result in part from the presence of the cavity 18D in the receiver 18. This overall compressibility 18K-18K also may have one or more subsets of compressibility arising from the individual compressibility of the top apron layer 18I portion of the side(s) 18E of the receiver 18, the individual compressibility of the skirt layer 18J and so on if additional ascending apron layers are used. A portion of this compressibility may arise from the fact that the side(s) 18E of the receiver are made of a compressible material such as an elastic polymer such as rubber, vinyl, polyurethane, silicon and the like. By way of example only, the subset compressibility of the apron layer 18I is depicted by the compression depicting arrows 18L-18L in FIG. 6A. Similarly, the skirt layer 18J may have its own compressibility features that are distinct from those of the apron layer 18I. In certain embodiments of this invention the lowest layer (the skirt layer 18J in physical contact with the soccer ball cover) will be more compressible relative to the adjacent higher layer (i.e., apron 18I). This increased compressibility can for example also follow from the fact that the lowest layer has a vertical thickness 18Q that is less than the vertical thickness 18R of the next higher layer (and so on if more higher layers are employed in the construction of the domed bolt shaft receiver 18). Moreover, a more compressible skirt region (relative to an apron region) can be achieved by making the walls 18S of the skirt region thinner than the walls of the apron region and so on. FIG. 6A shows the receiver 18 provided with a separate bolt hole piece 18T that is embedded in the body of receiver 18. This bolt hole piece 18T can be made of a metal, a hard plastic material and like strong, hard materials rather than a polymeric material.

Figure 7:
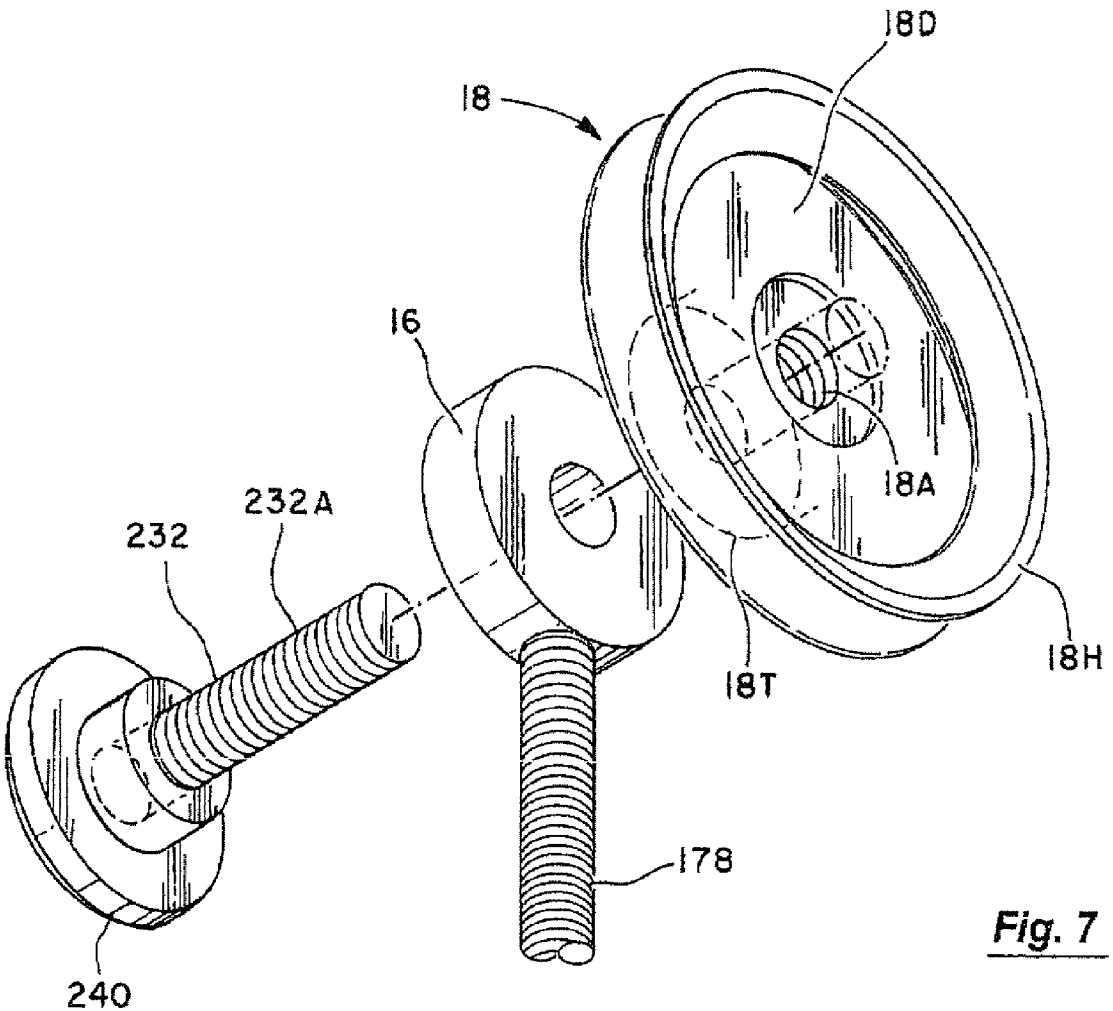
FIG. 7 is a perspective view of a domed bolt shaft receiver of the present patent disclosure shown having a hole for receiving a threaded bolt that will be attached to a soccer ball.
Figure 8:
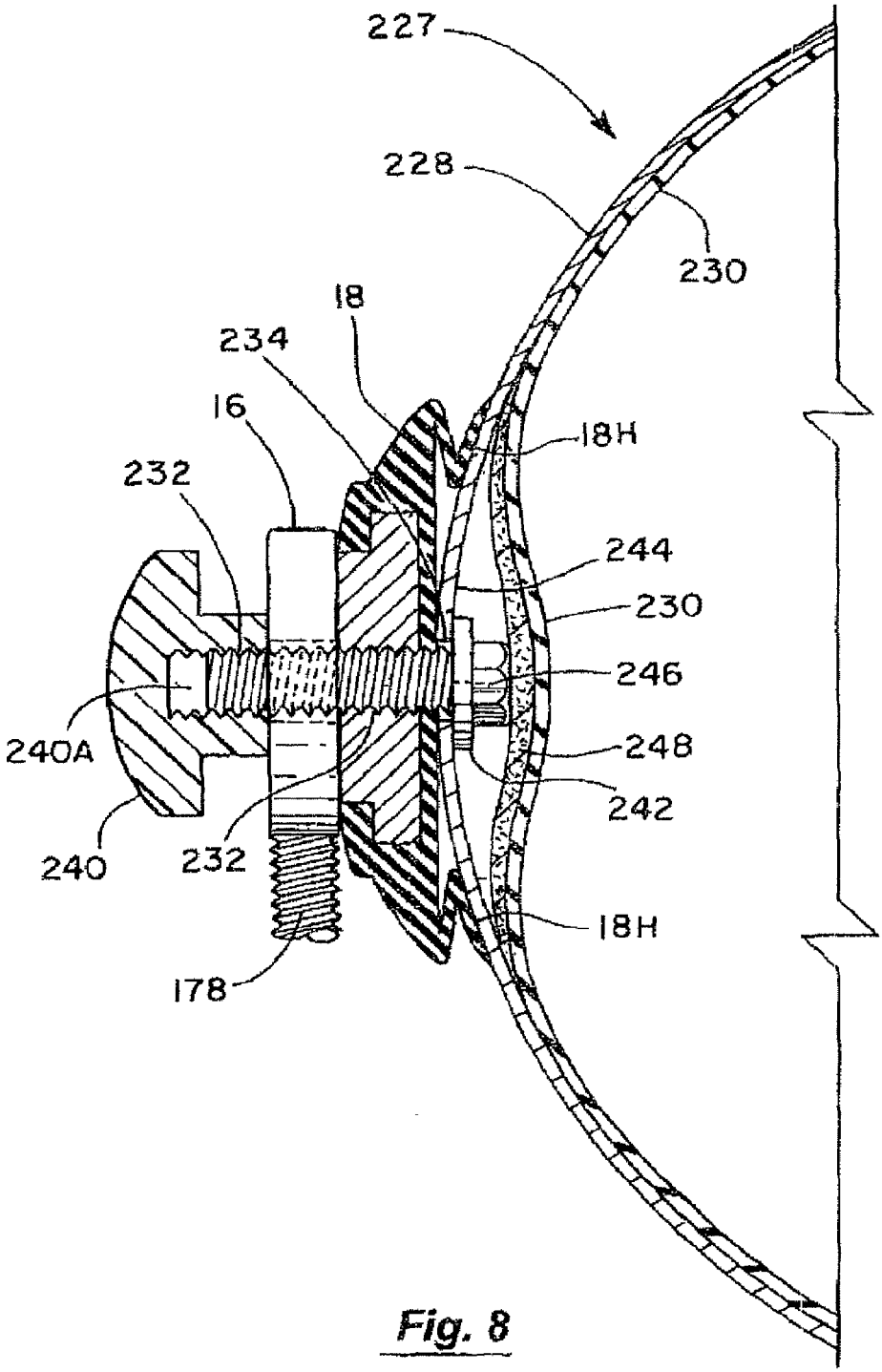
FIG. 8 is a cut-away side view of a soccer ball that is provided with a threaded bolt for mounting said ball to a soccer ball mounting system that includes a domed bolt shaft receiver constructed and mounted according to one embodiment of the present invention.

FIG. 7 is a perspective view of a domed bolt shaft receiver 18. It can, for example, be unitary in nature. Such a unitary construction can be achieved by injection molding said receiver 18 using a suitable polymeric material. It could also be made by casting or by machining a suitable domed bolt shaft receiver precursor work piece. Other embodiments of this domed bolt shaft receiver 18 will however be made of a compressible polymeric material such as rubber, latex, vinyl, polyurethane, silicon—and like compressible materials. Regardless of its construction material or method of manufacture, such a domed bolt shaft receiver 18 will have at least four additional features. It will have a bolt hole 18A, a hollow interior region 18D, an edge or rim 18H and be made of a material that is compressible under a pressure P delivered by torquing a knob 240. A torquing action on such a knob serves to press the rim 18H against the ball's outer cover 228 (see FIG. 8). Again, in one embodiment of this invention, the hole 18A will pass a bolt 232 that protrudes through the outer cover 228 of the ball 227 as shown in FIG. 8. In another embodiment of this invention, (as shown in FIG. 7) the hole 18A will be threaded in order to threadedly engage with a threaded shaft 232A of a threaded bolt 232 that is affixed to, and protrudes from, the knob 240. A threaded bolt hole piece 18T is shown in phantom lines in FIG. 7 to suggest that this piece 18T may or may not be present in the receiver 18. The threaded bolt hole piece 18T can be made of a strong, tough metallic material and be embedded into the domed bolt shaft receiver 18. Use of a metallic bolt hole piece 18T will serve to allow greater forces to be applied to the bolt 232/bolt hole piece 18S system.

In any case, the torque created by progressively tightening such a knob 240 will create forces capable of compressing the receiver 18 between the plate 16 and the ball cover 228. Such forces can be created by human hand power or tools such as wrenches and sockets that may be hand operated or electrically and/or air powered. Because the torquing forces delivered by the knob 240 are relatively powerful, the threaded bolt 232 should be made of a strong, tough material such as steel, titanium, a strong, tough polymer such as an acrylic type polymer, etc.

FIG. 8 is a side cut-away view of a soccer ball 227 provided with a mounting bolt 232 that passes through a soccer ball holder 16 of the type used in the present invention. The soccer ball 227 has an outer cover 228 and an inner air-inflatable bladder 230 common to most commercially available soccer balls. The mounting bolt 232 passes through a hole 234 in the soccer ball cover 228. This bolt 232 is also shown passing through a threaded soccer ball holder 16. The soccer ball cover 228, domed bolt shaft receiver 18 and soccer ball holder 16 can thus be tightly abutted to each other through use of such a threaded bolt and a cooperating threaded nut. FIG. 8 depicts such a threaded nut as being a part of a hand operable knob 240 having an internally threaded hole 240A. A washer 242 also can be placed between the inside 244 of the soccer ball cover 228 and the bolt head 246. A bolt head padding piece 248 can be placed between the bolt head 246 and the bladder 230. The soccer ball 227 is thus firmly abutted to the bottom edge or lip 18H of the domed bolt shaft receiver 18. Again, in the alternative, the knob 240 could be provided with a threaded bolt shaft that, by way of example, threads into a nut (not shown) that can be thought of as generally replacing the bolt head 246 in FIG. 8.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

What is claimed is:

1. A soccer kicking practice apparatus comprising:

(a) a soccer ball;

(b) a flexible center shaft;

(c) a soccer ball mounting device attached at one end to an outside end of the flexible center shaft and at an opposite end attached to a T-shaped connector and wherein said flexible center shaft further comprises a plate having a hole for receiving a threaded bolt shaft; and (d) a domed bolt shaft receiver having a hole capable of passing the threaded bolt shaft and wherein the sides of the domed bolt shaft receiver are capable of undergoing compression under a force delivered by a nut having a threaded hole that threadedly cooperates with the threaded bolt shaft and wherein the sides undergoing compression have a lip region for conforming to the soccer ball's outer contour under a force delivered by the nut as it threadedly cooperates with the threaded bolt shaft.

2. The domed bolt shaft receiver of claim 1 that further comprises a threaded bolt hole piece embedded in the domed bolt shaft receiver.

3. The domed bolt shaft receiver of claim 1 wherein the sides capable of undergoing compression have an apron/skirt cross sectional configuration.

4. The domed bolt shaft receiver of claim 1 wherein the sides capable of undergoing compression have an apron/skirt cross sectional configuration and wherein a skirt portion thereof is more compressible than an apron portion thereof.

5. A soccer kicking practice apparatus comprising:

(a) a soccer ball;

(b) a center shaft made in the form of a roller chain mounted such that it is horizontally flexible;

(c) a coil spring that surrounds a major portion of the center shaft and a coil spring compression/decompression device;

(d) a connector attached to an inside end of the center shaft and wherein said connector has a T-shaped configuration whose top element is capable of being slidably mounted on a holding post that is affixed to a substantially vertical construction element;

(e) a holding post capable of slidably receiving the top element of the connector;

(f) a soccer ball mounting device attached to an outside end of the center shaft and wherein said center shaft further comprises a plate having a hole for receiving a threaded bolt that is attached to a soccer ball;

(g) a domed bolt shaft receiver having a hole capable of passing a threaded bolt shaft that protrudes from a soccer ball;

(h) a nut having a threaded hole capable of threadedly cooperating with the threaded bolt shaft; and (i) sides capable of undergoing compression under a force delivered by the nut as it threadedly cooperates with the soccer ball's protruding threaded bolt shaft.

6. The soccer kicking practice apparatus of claim 5 wherein the bolt attached to the soccer ball is replaced by a threaded bolt that is attached to a knob and wherein the nut having a threaded hole is attached to the soccer ball.

7. The domed bolt shaft receiver of claim 5 that further comprises a threaded bolt hole piece embedded in the domed bolt shaft receiver.

8. The domed bolt shaft receiver of claim 5 wherein the sides capable of undergoing compression have an apron/skirt cross sectional configuration.

9. The domed bolt shaft receiver of claim 5 wherein the sides capable of undergoing compression have an apron/skirt cross sectional configuration and wherein a skirt portion thereof is more compressible than an apron portion thereof.

* * * * *